US007908711B2

(12) United States Patent
Johnson

(10) Patent No.: US 7,908,711 B2
(45) Date of Patent: Mar. 22, 2011

(54) HINGE-MOUNTED HANGER SYSTEMS

(76) Inventor: William James Johnson, Victoria (CA)

( * ) Notice: Subject to any disclaimer, the term of this patent is extended or adjusted under 35 U.S.C. 154(b) by 305 days.

(21) Appl. No.: 12/050,730

(22) Filed: Mar. 18, 2008

(65) Prior Publication Data

US 2008/0230500 A1 Sep. 25, 2008

Related U.S. Application Data

(60) Provisional application No. 60/895,647, filed on Mar. 19, 2007.

(51) Int. Cl.
*E05D 3/06* (2006.01)

(52) U.S. Cl. ..... 16/366; 16/368; 16/369

(58) Field of Classification Search ..... 16/277, 16/282, 286, 302, 311, 339, 353, 382, 388, 16/390, DIG. 29, 366, 368, 369; 211/119.004, 211/169, 199; 248/213.1
See application file for complete search history.

(56) References Cited

U.S. PATENT DOCUMENTS

| | | | | | |
|---|---|---|---|---|---|
| 496,173 | A * | 4/1893 | Smith | 211/75 |
| 914,697 | A * | 3/1909 | Bryant | 248/290.1 |
| 2,561,806 | A * | 7/1951 | Mailand | 211/96 |
| 2,595,521 | A * | 5/1952 | Hanson | 211/119.004 |
| 2,633,997 | A * | 4/1953 | Johnson | 211/96 |
| 2,684,225 | A * | 7/1954 | Johnson | 248/213.1 |
| 2,895,698 | A * | 7/1959 | Palmer | 248/213.1 |
| 3,044,630 | A * | 7/1962 | Szabo | 211/119.004 |
| 3,175,696 | A * | 3/1965 | Milbourne | 211/119.004 |
| 3,526,922 | A * | 9/1970 | Kellems | 16/387 |
| 3,825,127 | A * | 7/1974 | Morrison et al. | 211/96 |
| 4,389,748 | A * | 6/1983 | Grossman | 16/278 |
| 4,721,212 | A * | 1/1988 | Lowe | 211/119.004 |
| 5,158,503 | A * | 10/1992 | Mitchell | 16/278 |
| 5,282,293 | A * | 2/1994 | Pedoeem | 16/342 |
| 6,173,476 | B1 * | 1/2001 | Daoud | 16/323 |
| 6,196,398 | B1 * | 3/2001 | Lowe | 211/96 |
| 6,206,210 | B1 * | 3/2001 | Reed | 211/96 |
| 6,712,228 | B2 * | 3/2004 | Lowe | 211/119.004 |
| 6,722,511 | B1 * | 4/2004 | Lowe | 211/119.004 |
| 2003/0146179 | A1 * | 8/2003 | Lowe | 211/119.004 |

* cited by examiner

*Primary Examiner* — Shane Bomar
*Assistant Examiner* — Roberta Delisle

(57) ABSTRACT

A device for mounting on a door hinge, of the type having intermeshing sleeves held together by a hinge pin, for supporting clothes and other items. A hinge-mounted hanger kit for use with different sized hinges, including a hanger for attaching to a hinge using an overlength pin to replace the hinge pin and a spacer or selection of spacers for use in accommodating different sized hinges. An extender for use with a hinge-mounted hanger for displacing the pivot axis of the hanger from the hinge pivot axis and having two different sized receptacles for receiving different sized hinges. A swing-restraint clip for use with a hinge-mounted hanger for attaching to a hinge and interposing between the hanger and an adjacent surface for impeding pivoting movement of the hanger relative to the surface.

10 Claims, 14 Drawing Sheets

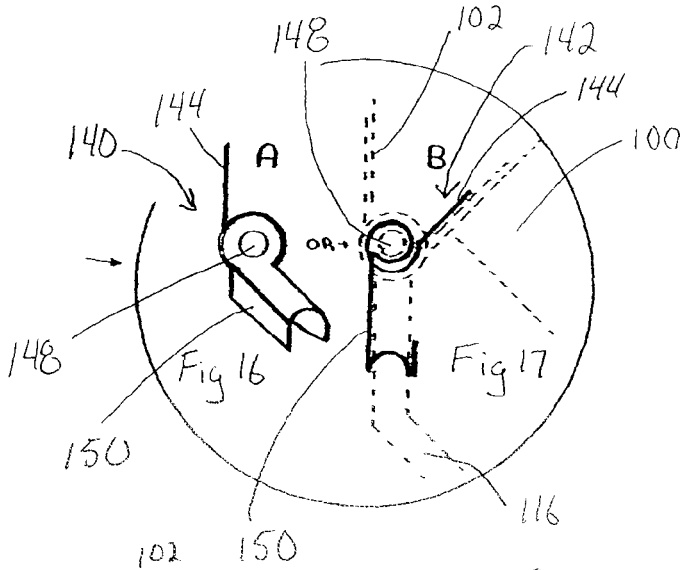
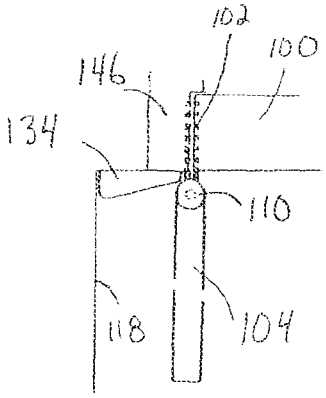
Fig 2
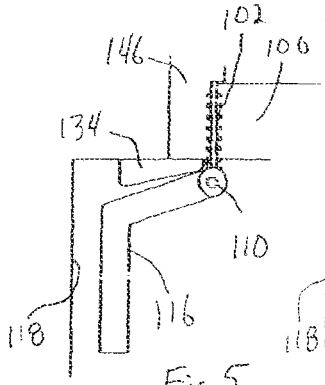
Fig 5
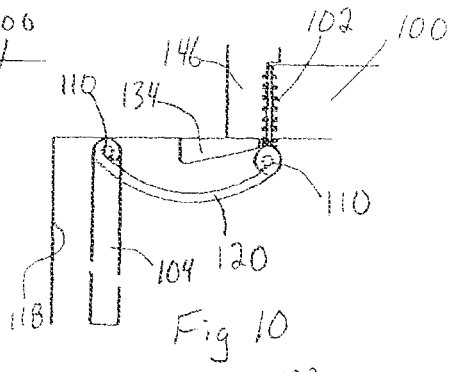
Fig 10
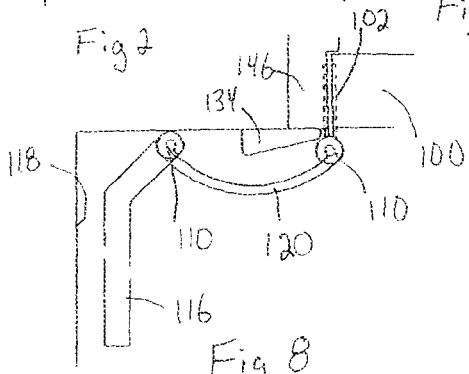
Fig 8
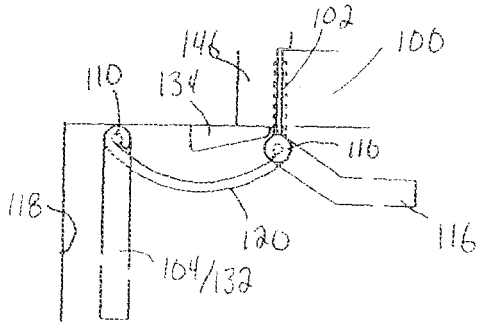
Fig 15

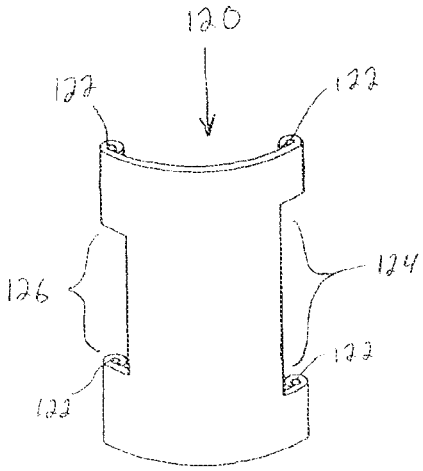
Fig 6
Fig 18
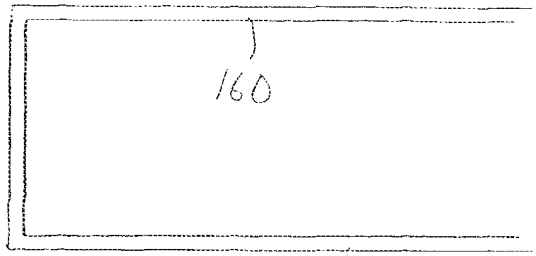
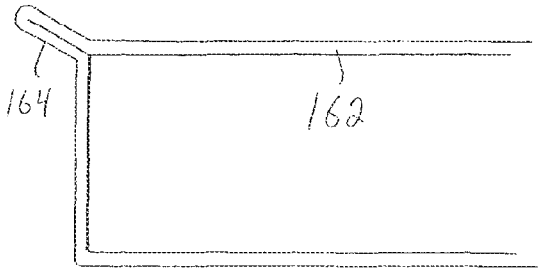
Fig 19
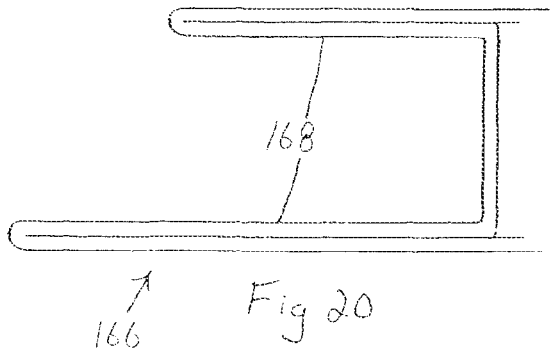
Fig 20

HINGE-MOUNTED HANGER SYSTEMS

This application claims the benefit of U.S. Provisional Application No. 60/895,647, filed 19 Mar. 2007 and titled Hinge-mounted Hanger Systems.

FIELD OF THE INVENTION

This invention relates generally to devices for mounting on door hinges and more particularly devices for supporting clothes and other items for mounting on door hinges.

BACKGROUND OF THE INVENTION

Devices for mounting on door hinges for supporting clothing and other items are known and include those disclosed in the following U.S. Pat. No. 3,825,127, Hinge Hanger, Morrison et al., issued 23 Jul. 1974; No. 2,595,521, Clothes Drying Rack, Hanson, issued 6 May 1952; No. 3,044,630, Hinge Pin Hook, Szabo, issued 17 Aug. 1962; No. 2,927,761, Hinge Mounted Support, Martiello, issued 8 Mar. 1960; No. 2,128,596, Clothes Hanger, Redin, issued 30 Aug. 1938; No. 5,117,987, Garment Support, Lombardo, issued 2 Jun. 1992; No. 1,208,986, Combination Hinge and Rack, Krodel, issued 19 Dec. 1916; and No. 3,200,435, Hanger For Use With A Hinge, Hemmeter et al., issued 17 Aug. 1965.

SUMMARY OF THE INVENTION

In accordance with an aspect of the present invention, there is provided a hinge-mounted hanger kit for use with different sized hinges, the kit including:

a) a hanger pin;

b) a hanger having two spaced-apart aligned hanger-pin-receiving holes, an upper receiving hole and a lower receiving hole; and c) at least one spacer having an opening through which the hanger pin may pass, wherein, in use, if the span between the receiving holes is greater, by the thickness of the spacer, than the size of the hinge, the hanger may be installed by removing the hinge pin and inserting the hanger pin through the upper receiving hole, the hinge, the spacer and the lower receiving hole.

In accordance with another aspect of the present invention, there is provided an extender for use with a hinge-mounted hanger having two spaced-apart aligned hanger-pin-receiving holes, an upper receiving hole and a lower receiving hole, and two hanger pins; for use with hinges of small and large sizes, the extender including:

a) on one side, a larger cavity defined by two aligned pin passages, spaced apart one from the other a sufficient distance to receive between them a hinge of the large size; and b) on the opposite side, a smaller cavity defined by two aligned pin passages, spaced apart one from the other a sufficient distance to receive between them a hinge of the small size;

wherein c) if the hanger is to be mounted on a large hinge, the extender is secured to the large hinge by disposing the hinge within the larger cavity and inserting a hanger pin through one pin passage, the hinge and the other pin passage, and the hanger is secured to the extender by passing a hanger pin through the upper receiving hole, the pin passages associated with the smaller cavity and the lower receiving hole; and d) if the hanger is to be mounted on a small hinge, the extender is secured to the small hinge by disposing the hinge within the smaller cavity and inserting a hanger pin through one pin passage, the hinge and the other pin passage, and the hanger is secured to the extender by passing a hanger pin through the upper receiving hole, the pin passages associated with the larger cavity and the lower receiving hole;

whereby, when installed the hanger may pivot relative to the extender and the extender may pivot relative to the hinge.

Preferably, the extender is configured for use with a second hanger mounted at the hinge end of the extender.

In accordance with another aspect of the present invention, there is provided a swing-restraint clip for use with a hinge-mounted hanger having two spaced-apart aligned hanger-pin-receiving holes, an upper receiving hole and a lower receiving hole, and in use secured to a hinge by a hanger pin having a head and inserted through the upper receiving hole, the hinge and the lower receiving hole, for restraining swing of the hanger relative to the adjacent door or door jam, the clip comprising:

a) a prong for insertion between a door and the adjacent door jam;

b) a hanger couple connected to the prong and configured for engaging a hanger; and c) a hanger pin aperture, located between the prong and hanger couple, suitable for receiving a hanger pin;

wherein, in use the clip is secured in place by a hanger pin passing through the hanger pin aperture, the hanger couple is secured to the hanger, and the prong is interposed between the door and door jam, whereby, the swing of the hanger is restrained by the prong abutting the door or door jam, as the case may be.

The swing-restraint clip may be made from a resilient material such that the clip provides some give at the limits of hanger movement provided by the clip. Alternatively, the clip may be made from a semi-rigid but deformable material such that the clip may be deformed so as to adjust the range of pivotal movement of the associated hanger.

SUMMARY OF THE DRAWINGS

FIG. 2 is a top plan view of the hanger and hinge shown in FIG. 1.

FIG. 5 is a top plan view of the bent hanger and hinge shown in FIG. 4.

FIG. 6 is a perspective view of an extender.

FIG. 8 is a top plan view of the extender and hanger shown in FIG. 7.

FIG. 10 is a top plan view of the extender and hanger shown in FIG. 9.

FIG. 13 is a partially exploded perspective view of the extender of FIG. 6 installed with a planar hanger adjacent the hinge (and the door) and with a bent open-frame hanger at the distal end of the extender, wherein the door opens in the opposite direction from the door indicated in FIG. 11.

FIG. 14 is a partially exploded perspective view of the extender of FIG. 6 installed with a bent open-frame hanger adjacent the hinge (and the door) and with a planar hanger at the distal end of the extender, wherein the door opens in the opposite direction from the door indicated in FIG. 12.

FIG. 15 is a top plan view of the extender of FIG. 6 installed with a bent open-frame hanger adjacent the hinge (and the door) and with a planar hanger at the distal end of the extender.

FIG. 16 is a perspective view of a semi-rigid swing-restraint clip.

FIG. 17 is a top plan view of a resilient swing-restraint clip.

FIG. 18 is a front elevation isolation view of a rectangular open-frame hanger.

FIG. 19 is a front elevation isolation view of a hook open-frame hanger.

FIG. 20 is a front elevation isolation view of a rack open-frame hanger.

DETAILED DESCRIPTION WITH REFERENCE TO THE DRAWINGS

Figure 1:
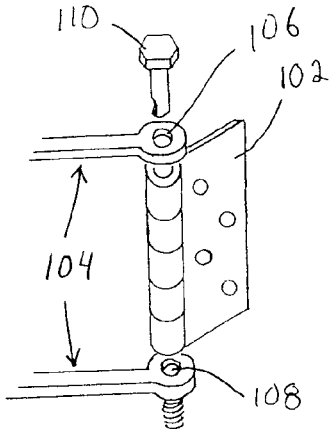
FIG. 1 is an isolation partially exploded perspective view of an open-frame hinge hanger connected to a hinge.

In the description of exemplary embodiments, the following feature names and reference numbers are used:

door 100
hinge 102
open-frame hanger 104
upper pin-receiving hole 106
lower pin-receiving hole 108
hanger pin 110
small hinge 112
spacer 114
bent open-frame hanger 116
wall 118
extender 120
pin passages 122
larger cavity 124
smaller cavity 126
nut 128
washer 130
solid hanger 132
casing 134
semi-rigid swing-restraint clip 140
resilient swing-restraint clip 142.
prong 144
door jam 146
hanger pin aperture 148
hanger couple 150
rectangular open-frame hanger 160
hook open-frame hanger 162
stub 164
rack open-frame hanger 166
arms 168
mortise solid hanger 170
block 172
eye rods 174
side-projecting towel rack 180
wire basket 182
box 184
removable coat hook 186
top rack 188
coat pegs 190
household equipment holders 192
garment notch 194
dado hanger 200
plate 202
groove 204
double-hinge mortise solid hanger 210
upper eye rods 212
lower eye rods 214

Doors 100 in residential premises are typically hung with two hinges 102. In commercial or office premises, doors 100 are often hung with three hinges 102. Hinges 102 suitable for use with doors 100 come in a conventional range of sizes, characterized by the vertical dimension of the installed hinge 102. The typically-used hinges 102 range in size from 3 inch to 6 inch, with intermediate sizes available in half-inch increments, that is 3½, 4, 4½, 5 and 5½ inch. For installation of the hanger systems described herein, the pins supplied with the hinges and the caps that are typically present at the bottom of the hinges are removed.

The term hanger is used herein to refer generally to various bodies that in use are connected to a hinge 102 to support other articles such as clothes, towels etc. Specific hangers are described in what follows, shown in the drawings and assigned particular reference numbers.

As shown in FIGS. 1 and 2, an open-frame hanger 104 having at its proximal end an upper pin-receiving hole 106 and a lower pin-receiving hole 108 (the pin receiving holes 106,108 aligned and spaced-apart one from the other), is pivotally attached to a hinge 100, by removing the pin and bottom cap (not shown) provided with the hinge 100; and inserting an overlength hanger pin 110 through the upper pin-receiving hole 106, the hinge 100 and the lower pin-receiving hole 108.

Preferably, the hanger pin 110 is threaded at its lower end and the lower pin-receiving hole 108 has mating internal threads, such that the hanger pin 110 may be screwed into the lower pin-receiving hole 108 so as to impede downward movement of the portion of the open-frame hinge hanger 104 proximate the lower pin-receiving hole 108. Alternatively, the hanger pin 110 may be threaded into a conventional nut (not shown) below the lower pin-receiving hole 108 so as to impede downward movement of the portion of the open-frame hinge 104 proximate the lower pin-receiving hole 108. Alternatively, other means for securing the hanger pin 110, such as cotter pins or retaining clips (not shown), may be used.

Figure 3:
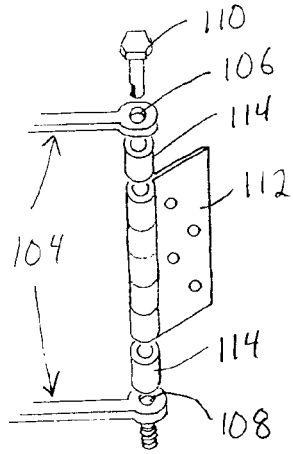
FIG. 3 is an isolation partially exploded perspective view of the hinge hanger of FIG. 1 connected to a smaller hinge than that shown in FIG. 1, wherein the connection means includes spacers.

The open-frame hanger 104 and hanger pin 110 shown in FIG. 1, are shown in FIG. 3 installed on a small hinge 112 (that is, a hinge that is smaller than the hinge 102 shown in FIG. 1 such that the vertical dimension of the small hinge 112 is less than the gap between the space between the upper pin-receiving hole 106 and the lower pin-receiving hole 108), with spacers 114. The spacers 114 are sized so that one spacer 114 is all that is required to adjust between the normal step in size between hinges of adjacent sizes. That is, if the size difference between the usual hinges with which the hinge hanger 104 and hanger pin 110 are intended to be used is ½ inch (e.g. hinges sized 3, 3½, 4, 4½, 5, 5½ and 6 inches), then the vertical dimension of the spacers is ½ inch.

Figure 4:
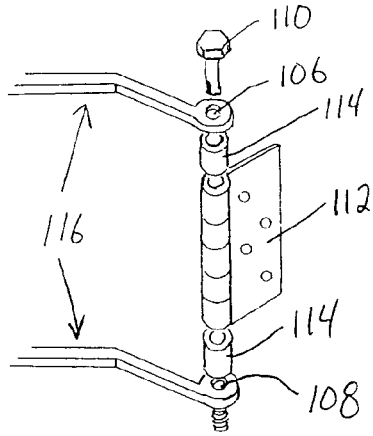
FIG. 4 is an isolation partially exploded perspective view of a bent open-frame hinge hanger connected to a hinge in the same manner as the hinge hanger of FIG. 3.

A bent open-frame hanger 116 is shown in FIG. 4 installed on a small hinge 112 with two spacers 114. As shown in FIG. 5, a bent open-frame hanger 116 may be advantageously installed on a hinge adjacent an inner corner, as the bend in the bent open-frame hanger 116 may be oriented such that the portion of the bent open-frame hanger 116 for supporting clothes or other items, may be positioned roughly parallel to the adjacent wall 118 and sufficiently close to the wall 118 so as to be out of the way. Alternatively, the bend in a bent open-frame hanger 116 permits the portion of the bent open-frame hanger 116 for supporting clothes or other items to be positioned roughly parallel to the door 100 with a desired clearance between the bent open-frame hanger 116 and the door 100.

In one embodiment, the space between the upper pin-receiving hole 106 and the lower pin-receiving hole 108 of a hanger is preferably sufficient to interpose there between the largest of the expected range of hinges. The hanger and hanger pin 110 are provided to the end users with sufficient spacers 114 to accommodate all of the hinges within the expected range of hinge sizes. For example, if the expected range of hinge sizes is as follows, 3, 3½, 4, 4½, 5, 5½ and 6 inches, then the space between the upper pin-receiving hole 106 and the lower pin-receiving hole 108 will be sufficient for a 6-inch hinge 102 to be interposed therein in a loose fit and the hanger and hanger pin 110 will be provided to the user with six ½ inch spacers 114, such that the user can use the hanger with: a 5½-inch hinge using one spacer 114; a 5-inch hinge using two spacers 114; a 4½-inch hinge using three spacers 114; etc.

Alternatively, the expected range of hinge sizes may be accommodated by providing a selection of hangers having different spaces between their upper pin-receiving holes 106 and lower pin-receiving holes 108. For example, an expected range of hinge sizes of 3, 3½, 4, 4½, 5, 5½ and 6 inches, could be accommodated by two different hanger sizes, one having a space between its upper pin-receiving hole 106 and lower pin-receiving hole 108 of 4½ inches and the other 6 inches, the first provided to the end user with at least three ½ inch spacers 114 and the second with at least two ½ inch spacers 114. In this way, the first of the hangers could be used with hinges of the following sizes, 3, 3½, 4 and 4½ inches, and the second, with hinges of the following sizes, 5, 5½ and 6 inches.

An extender 120 is shown in FIG. 6. The extender 120 comprises a generally curved body having at each side a pair of aligned spaced-apart pin passages 122. Between each pair of pin passages 122 there is a generally rectangular hinge-receiving cavity, a larger cavity 124 on one side of the extender 120 and a smaller cavity 126 on the other side of the extender 120. The extender 120 is preferably made from plate metal, cut, rolled and curved into the desired shape, but it may be made from any suitable material.

Figure 7:
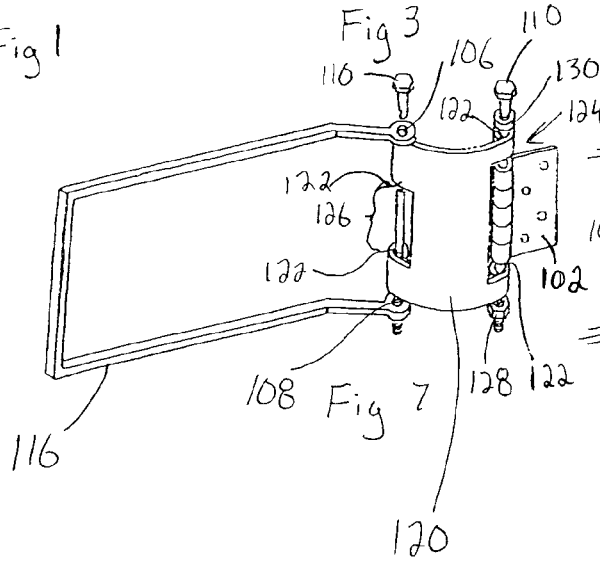
FIG. 7 is a partially exploded perspective view of the extender of FIG. 6 installed with a bent open-frame hinge hanger.
Figure 9:
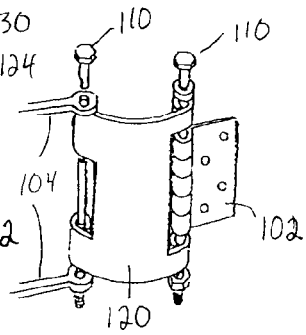
FIG. 9 is an isolation partially exploded perspective view of the extender of FIG. 6 installed with a straight open-frame hanger.

An extender 120 is shown in use with a bent open-frame hanger 116 in FIGS. 7 and 8, and with an open-frame hanger 104 in FIGS. 9 and 10 (FIG. 10 is illustrative of an extender 120 in use with any generally rectilinear hanger). In FIG. 7, the extender 120 is shown with a hinge 100 in the larger cavity 124; and a hanger pin 110 passing through the pin passages 122 and the hinge 100, and secured with a nut 128. The bent open-frame hanger 116 is attached to the other side of the extender 120 with a hanger pin 110 passing through the upper pin-receiving hole 106 and the pin passages 122, and threaded into the lower pin-receiving hole 108. In the embodiment shown in FIG. 7, the hanger pin 110 used to connect the hinge 102 to the extender 120 is the same size as the hanger pin 110 used to connect the extender 120 to the bent open-frame hanger 116; and to avoid excess (and perhaps unsightly) projection of the hanger pin 110 through the nut 128, a spacing washer 130 is located between the top of hanger pin 110 and the top of the extender 120.

As shown in FIGS. 8 and 10, in many installations, an extender 120 clears the adjacent casing 134, and thus acts to prevent damage to the casing 134.

An extender 120 may also be used with a small hinge 112 by either inserting one or more spacers 114 with the small hinge 112 in the larger cavity 124; or locating the small hinge 112 in the smaller cavity 126 and, if required, inserting one or more spacers 114 with the small hinge 112 in the smaller cavity 126.

Figure 11:
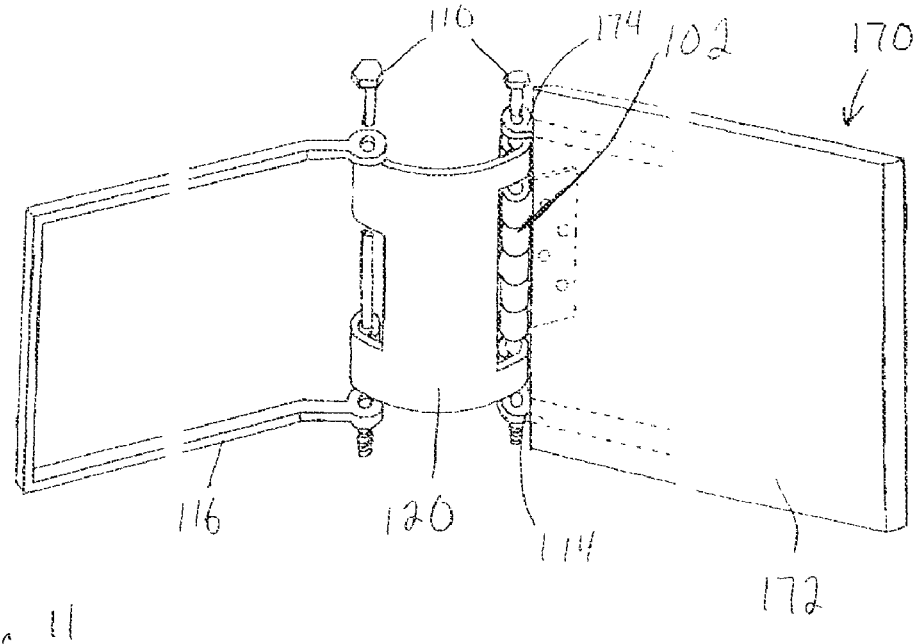
FIG. 11 is a partially exploded perspective view of the extender of FIG. 6 installed with a planar hanger adjacent the hinge (and the door) and with a bent open-frame hanger at the distal end of the extender.
Figure 12:
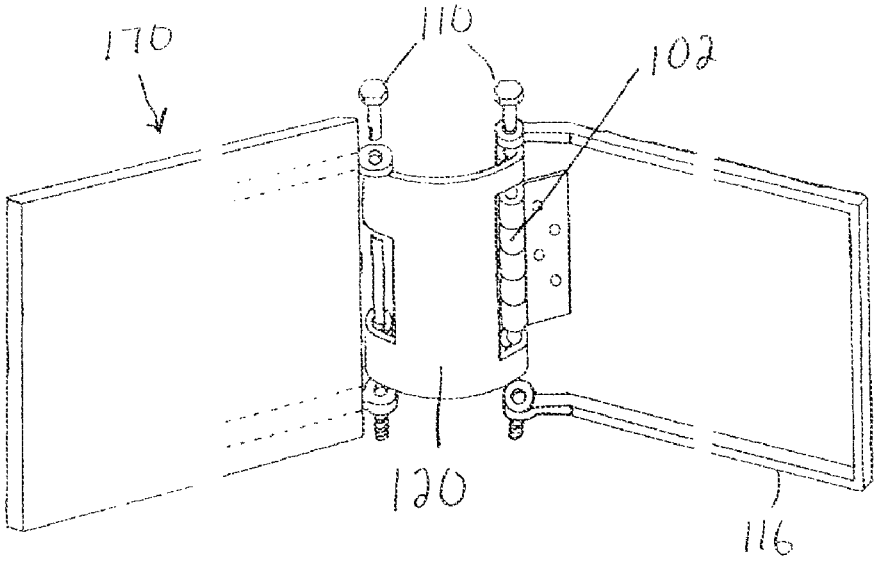
FIG. 12 is a partially exploded perspective view of the extender of FIG. 6 installed with a bent open-frame hanger adjacent the hinge (and the door) and with a planar hanger at the distal end of the extender.
Figure 13:
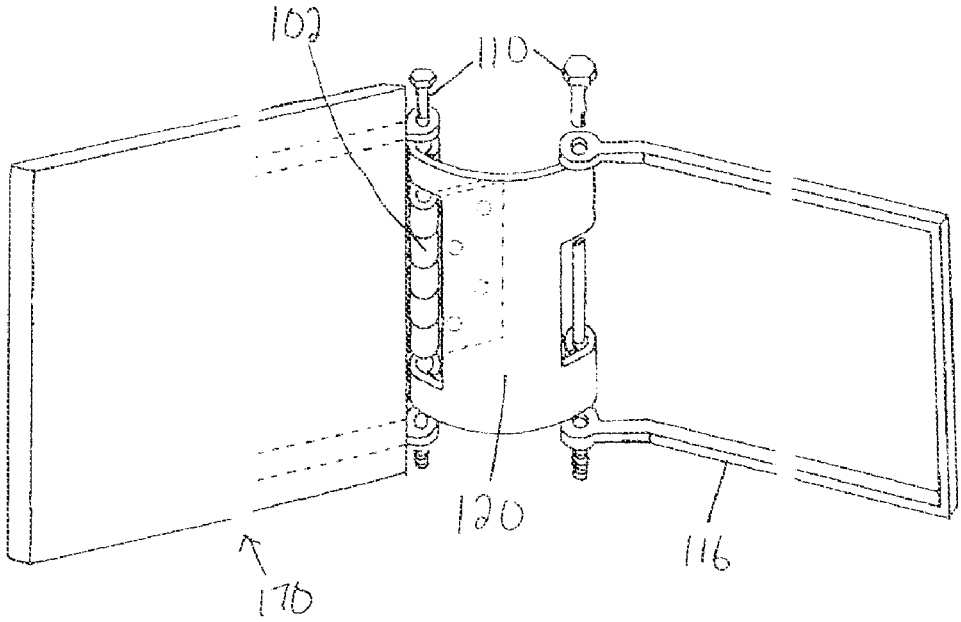
FIG. 13 is essentially the mirror image of FIG. 11, that is.
Figure 14:
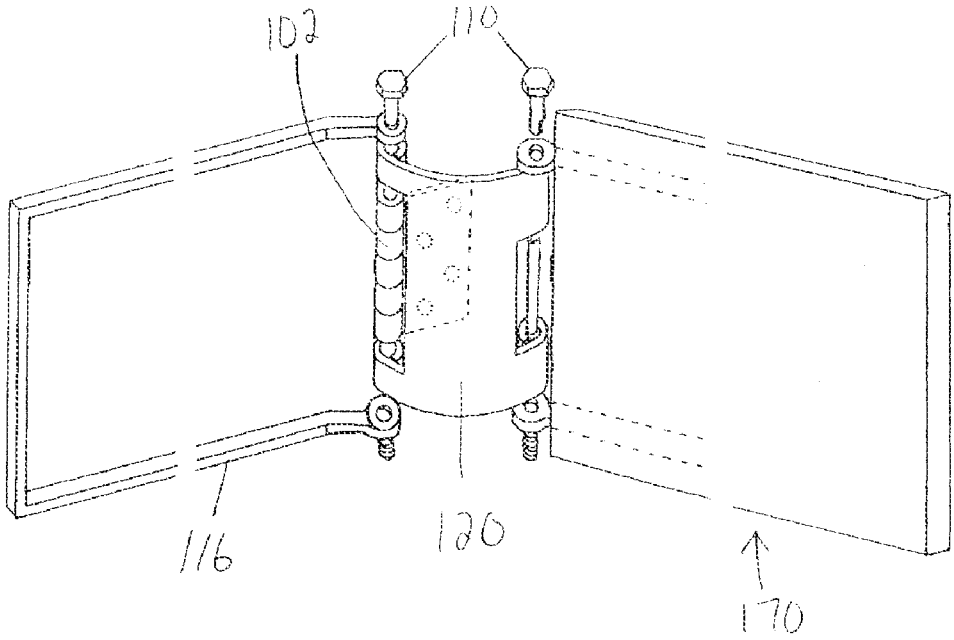
FIG. 14 is essentially the mirror image of FIG. 12, that is.

As shown in FIGS. 11 to 14, an extender 120 may be used to connect two hangers to one hinge 102. FIG. 11 shows an extender 120 used to mount a solid hanger 132 at a hinge 100 and a bent open-frame hanger 116 at the other side of the extender 120. FIG. 12 shows an extender 120 used to mount a bent open-frame hanger 116 at a hinge 100 and a solid hanger 132 at the other side of the extender 120. FIG. 13 shows a configuration that is a mirror-image of the general configuration shown in FIG. 11. FIG. 14 shows a configuration that is a mirror-image of the general configuration shown in FIG. 12. FIG. 15 shows an extender 120 used to mount a bent open-frame hanger 116 at the hinge 100 so as to permit its positioning roughly parallel to the door 100; and a generally rectilinear hanger (e.g. open-frame hanger 104 or solid hanger 132) at the other side of the extender 120 so as to permit it to be positioned roughly parallel to an adjacent wall 118.

FIG. 16 shows a semi-rigid swing-restraint clip 140 and FIG. 17 shows a resilient swing-restraint clip 142. The swing-restraint clips 140, 142 each comprises a prong 144 for insertion between a door 100 and the adjacent door jam 146; a hanger pin aperture 148 through which the relevant hanger pin 110 is inserted to hold the swing-restraint clip 140, 142 in the desired operational position; and a hanger couple 150 for engaging the relevant hanger. The resilient swing-restraint clip 142 is made from a rod-like material (preferably spring steel or other suitable spring material) and the hanger pin aperture 148 is formed by making an over-360 degree bend in the rod-like material. As shown in FIG. 17, when installed, the prong 144 is located between the door 100 and door jam 146, such that pivotal movement of the bent open-frame hanger 116 causes the prong 144 to abut the door 100 or door jam 146 depending on the direction of movement of the bent open-frame hanger 116. In this way, the resilient swing-restraint clip 142 resiliently impedes pivotal movement of the associated bent open-frame hanger 116 away from the door 100 when the door 100 is open, and in either direction when the door 100 is closed. The semi-rigid swing-restraint clip 140 shown in FIG. 16 is preferably made from a sufficiently rigid, but slightly malleable material such that the angle between the prong 144 and the hanger couple 150 can be adjusted by bending the semi-rigid swing-restraint clip 140 to give a desired relative position for the hanger.

Alternatively, a swing-restraint clip could be configured (essentially as a mirror image of the swing-restraint clips 140, 142 shown in FIGS. 16 and 17) so as to prevent a hanger from swinging away from a preferred position (presumably roughly parallel) with respect to an adjacent wall (not shown).

As shown in FIGS. 18, 19 and 20, a variety of different frame configurations are possible for an open-frame hanger 104. FIG. 18 shows a rectangular open-frame hanger 160 having a rectangular frame configuration. FIG. 19 shows a hook open-frame hanger 162 having a projecting stub 164 at its upper corner, typically for use in hanging a garment such as a robe or coat. FIG. 20 shows a rack open-frame hanger 166 having two horizontal projecting arms 168 suitable for hanging items such as towels.

Figure 21:
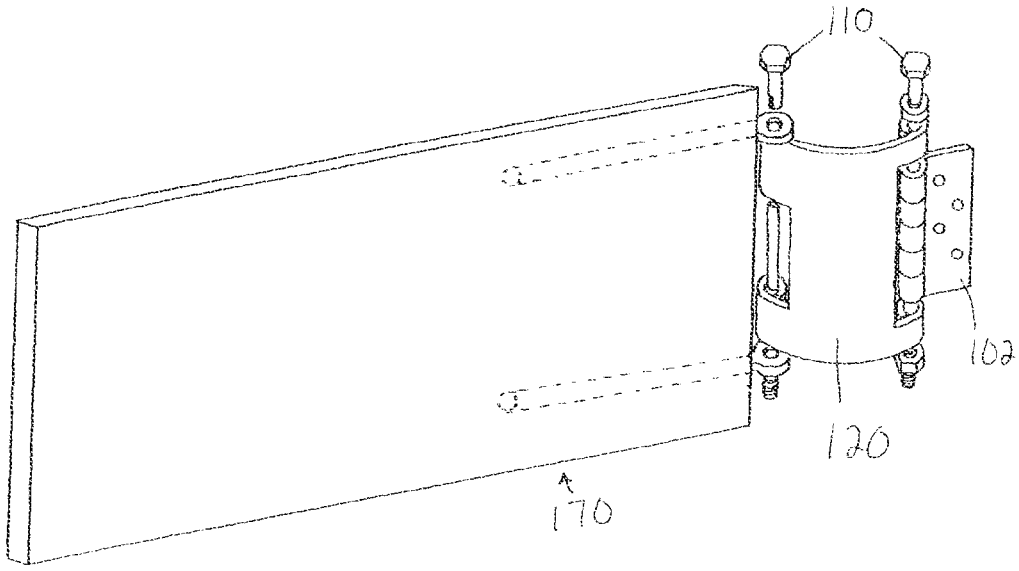
FIG. 21 is a perspective partially exploded view of a mortise solid hanger shown installed on a hinge with an extender.

A variety of different solid hanger configurations are also possible. As shown in FIG. 21, a mortise solid hanger 170 comprises a generally rectilinear block 172 (made of wood, plastic or other suitable material) from which eye rods 174 (in which the "eye" of one comprises the upper pin-receiving hole 106 and the "eye" of the other comprises the lower pin-receiving hole 108), project. Note that "mortise" is used herein to indicate that in a typical configuration, the eye rods 174 project from within the block 172. However, "mortise" should not be considered to imply that mortise holes are cut in the block 172 for the insertion of the eye rods 174, as the eye rods 174 may be cast in place. Further, in non-typical configurations, the eye-rods may be integral to the block 172, such as where the block 172 and eye rods 174 are a one-piece casting.

Figure 22:
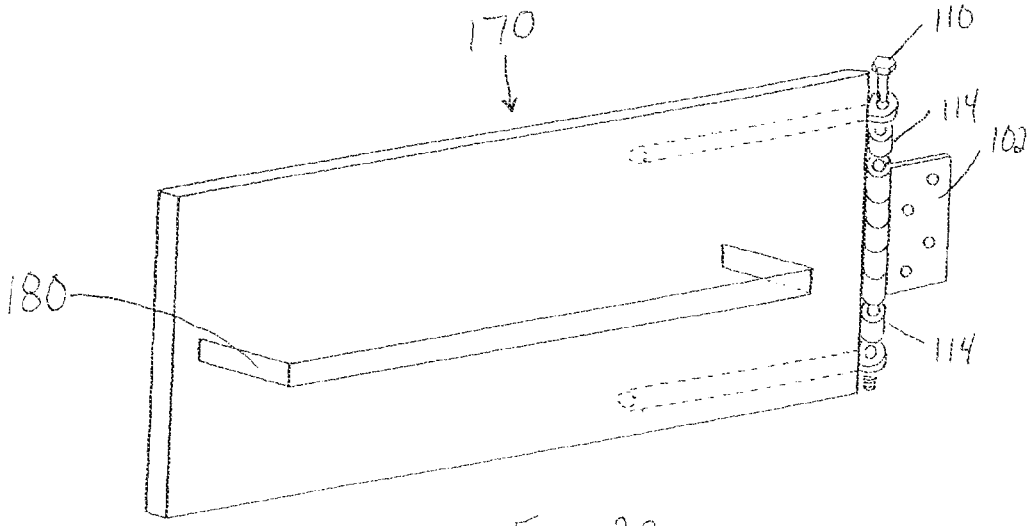
FIG. 22 is a perspective partially exploded view of a mortise solid hanger having a side-projecting rack and shown installed on a hinge.
Figure 23:
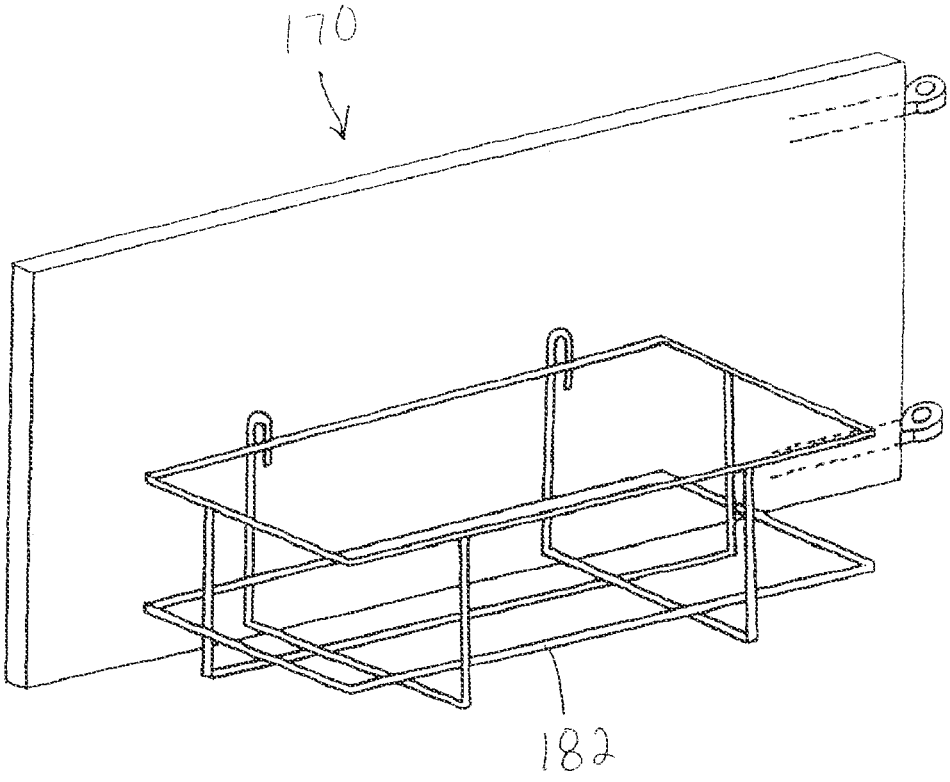
FIG. 23 is a perspective partially exploded view of a mortise solid hanger with an attached wire basket.
Figure 24:
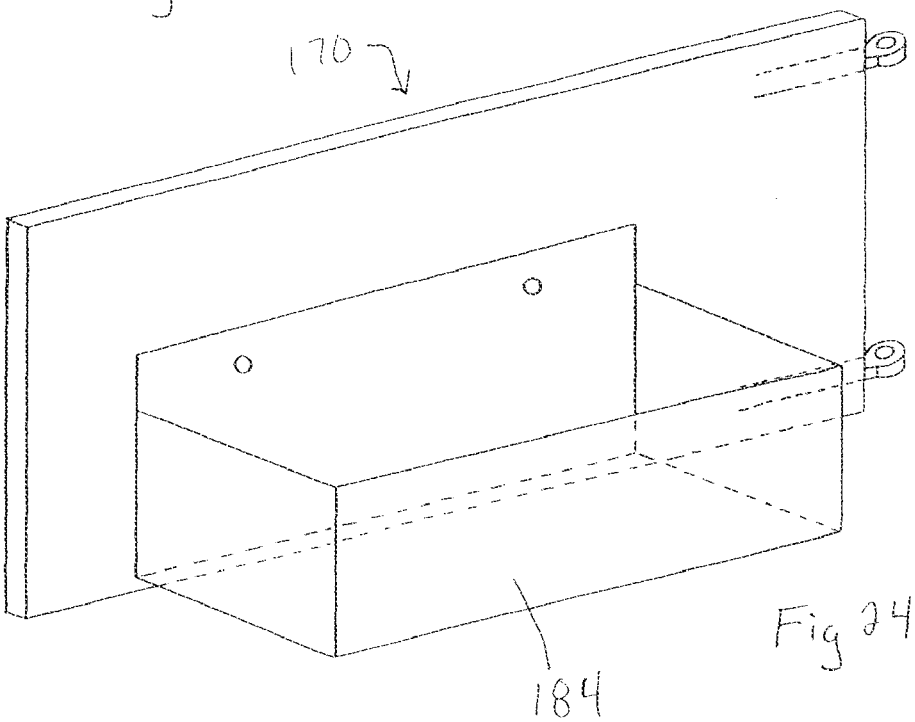
FIG. 24 is a perspective partially exploded view of a mortise solid hanger with an attached box.
Figure 25:
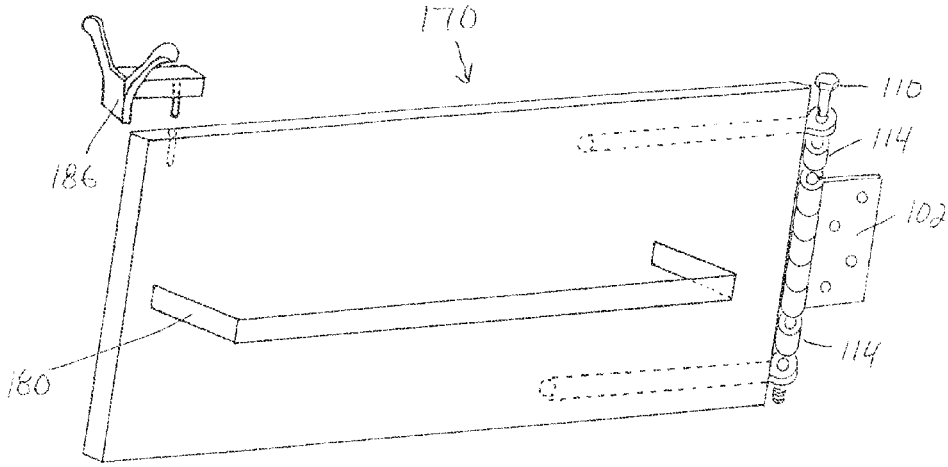
FIG. 25 is a perspective partially exploded view of a mortise solid hanger having a side-projecting rack and a removable coat hook, and shown mounted on a hinge.
Figure 26:
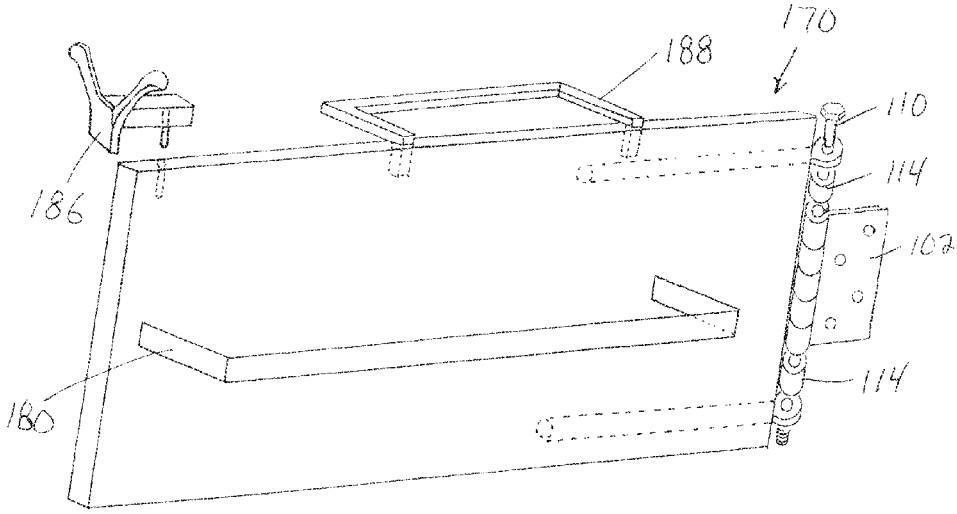
FIG. 26 is a perspective partially exploded view of a mortise solid hanger having a side-projecting rack, a top rack and a removable coat hook, and shown mounted on a hinge.
Figure 27:
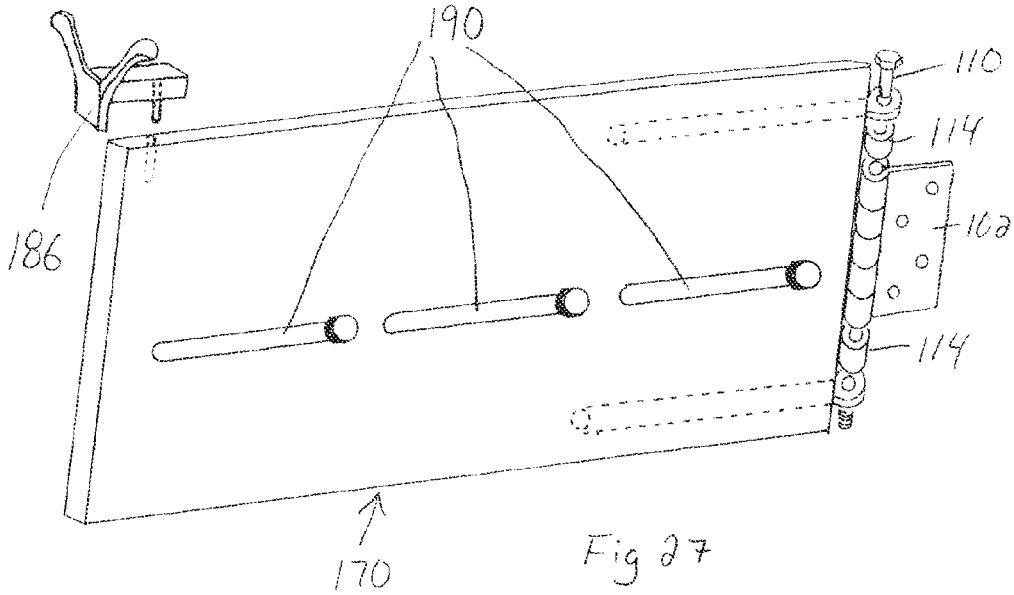
FIG. 27 is a perspective partially exploded view of a mortise solid hanger having projecting coat pegs and a removable coat hook, and shown mounted on a hinge.
Figure 28:
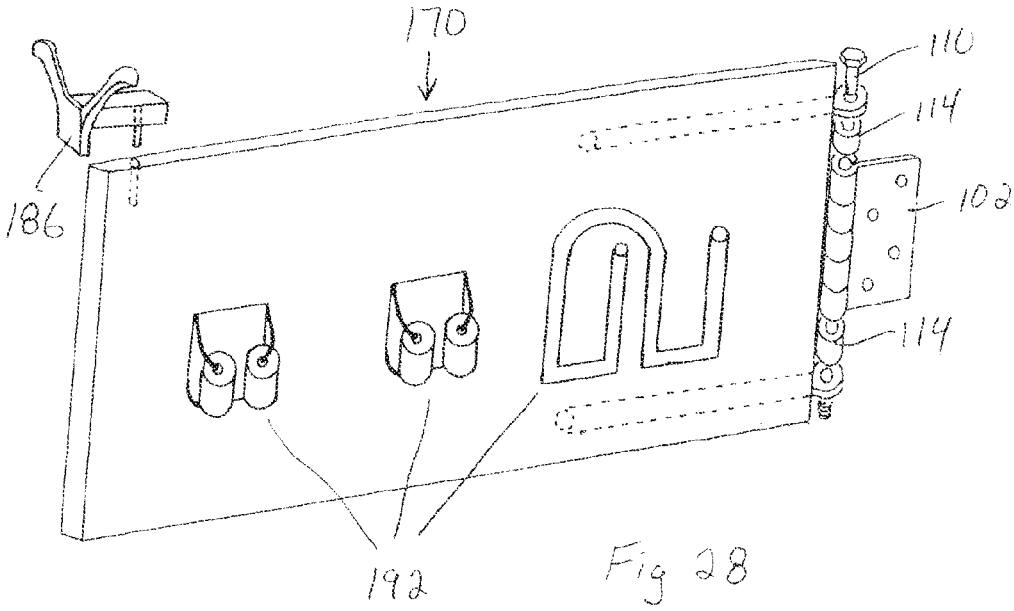
FIG. 28 is a perspective partially exploded view of a mortise solid hanger having household equipment holders and a removable coat hook, and shown mounted on a hinge.
Figure 29:
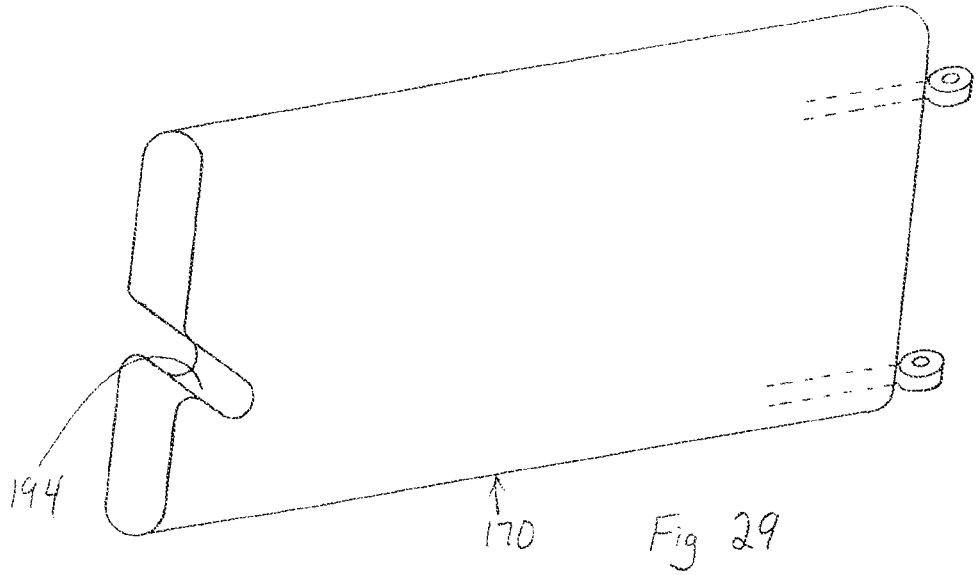
FIG. 29 is a perspective view of a mortise solid hanger having an integral garment notch.
Figure 30:
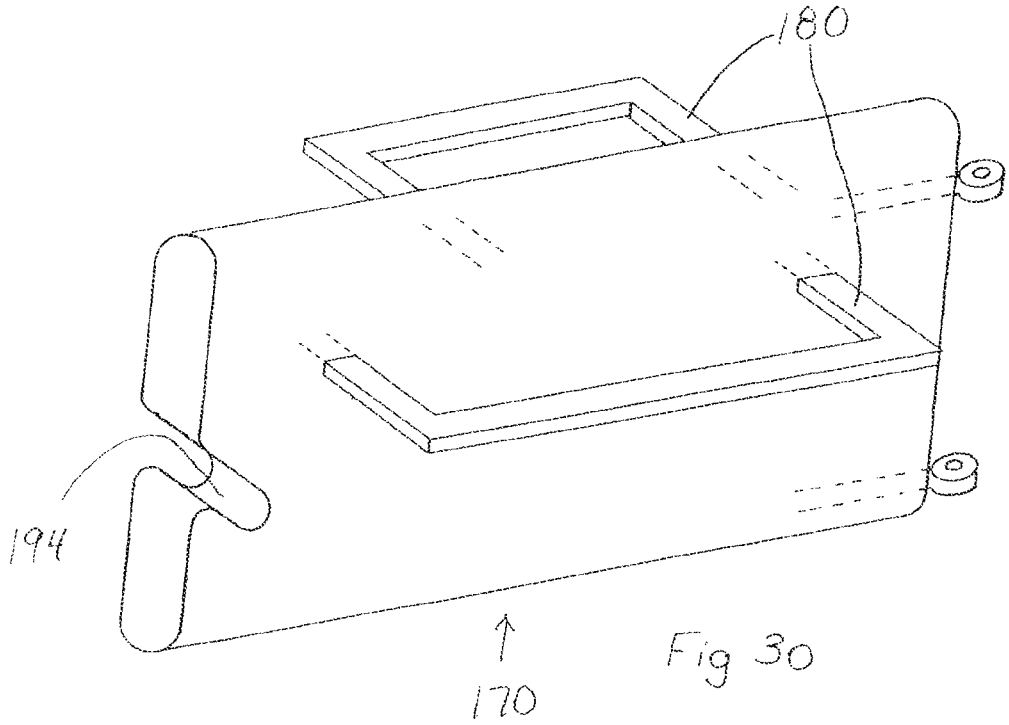
FIG. 30 is a perspective view of a mortise solid hanger having an integral garment notch and two side-projecting racks.

The solid hanger configuration permits the mounting of a variety of useful items. FIG. 22 shows a mortise solid hanger 170 having a side-projecting towel rack 180. FIG. 23 shows a mortise solid hanger 170 with an attached wire basket 182. FIG. 24 shows a mortise solid hanger 170 with an attached box 184. FIG. 25 shows a mortise solid hanger 170 having a side-projecting towel rack 180 and a removable coat hook 186. FIG. 26 shows a mortise solid hanger 170 having a side-projecting towel rack 180, a top rack 188 and a removable coat hook 186. FIG. 27 shows a mortise solid hanger 170 having projecting coat pegs 190 and a removable coat hook 186. FIG. 28 shows a mortise solid hanger 170 having household equipment holders 192 and a removable coat hook 186. FIG. 29 shows a mortise solid hanger 170 having an integral garment notch 194 suitable for hanging a robe, jacket or similar garment. FIG. 30 shows a mortise solid hanger 170 having an integral garment notch 194 and two side-projecting towel racks 180.

Figure 31:
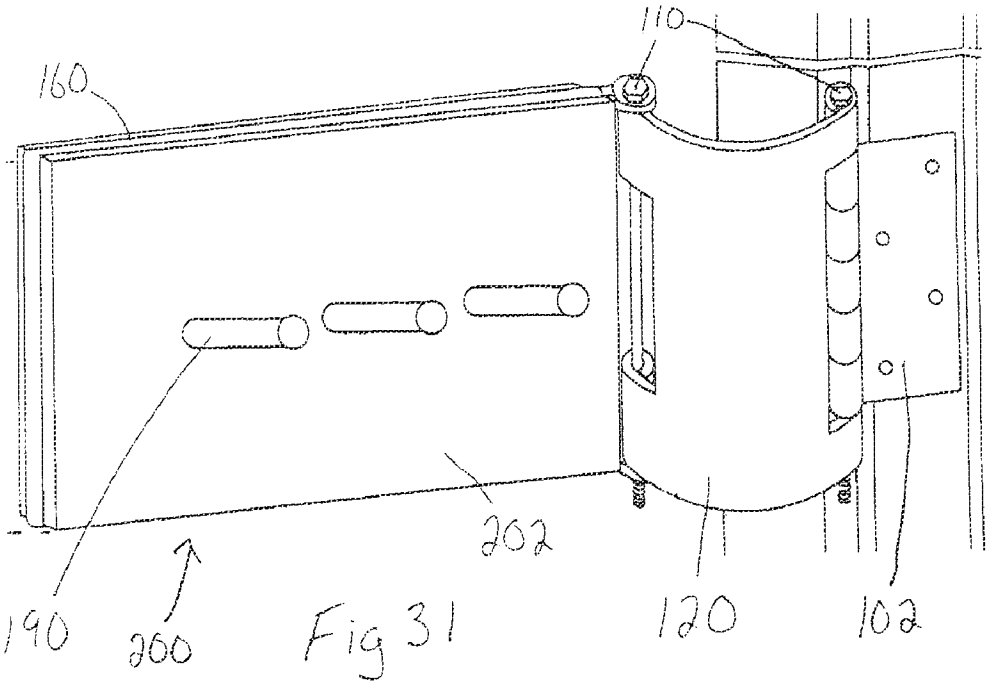
FIG. 31 is a perspective view of a dado solid hanger having projecting coat pegs and shown installed on a hinge with an extender.
Figure 32:
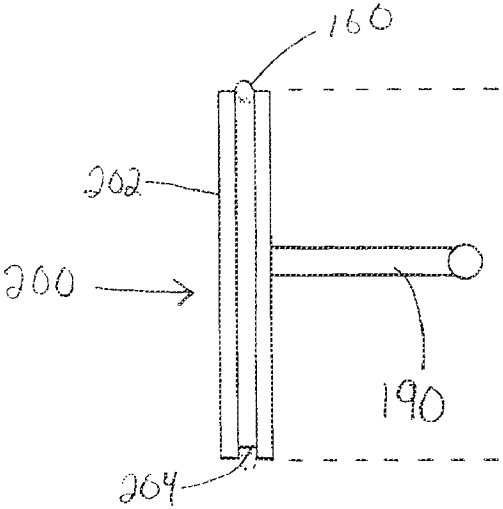
FIG. 32 is a side elevation view of the dado solid hanger of FIG. 31.

FIGS. 31 and 32 show a hybrid open-frame/solid-hanger configuration, referred to herein as a dado hanger 200, comprising a rectangular open-frame hanger 160 component and a plate 202 having a peripheral groove 204, wherein, when the dado hanger 200 is installed, the horizontal and vertical runs of the rod comprising the rectangular open-frame hanger 160 component lay within the groove 204, such that the plate 202 is held within the rectangular open-frame hanger 160.

Note that "dado" is used herein to indicate the existence of the peripheral groove 204 and should not be considered to imply that the groove 204 is necessarily cut; the groove 204 may be cast in the plate 202.

Preferably, the rectangular open-frame hanger 160 component is sufficiently resiliently flexible such that when the dado hanger 200 is not installed (that is, when the horizontally extending runs of the open-frame hanger 160 component are not held in a fixed spaced apart relationship by a hanger pin 110), the horizontally extending runs of the open frame hanger 160 component may be moved apart sufficiently to remove the plate 202 from the open-frame hanger 160 component so as to reorient the plate 202 within the open-frame hanger 160 component as desired. For example, in the embodiment shown in FIGS. 31 and 32, the plate 202 has projecting coat pegs 190. If it was desirable in a particular application to have the coat pegs 190 project in the opposite direction to that shown in FIGS. 31 and 32, as the lower pin-receiving hole 108 in the open-frame hanger 160 component is preferably threaded to receive the hanger pin 110, it would not be desirable to rotate the whole dado hanger 200 180 about a horizontal axis as this would mean inserting the hanger pin 110 from the bottom of the dado hanger 200. However, the plate 202 could be rotated 180 to a new position within the open-frame hanger 160 component to achieve the desired result.

Figure 33:
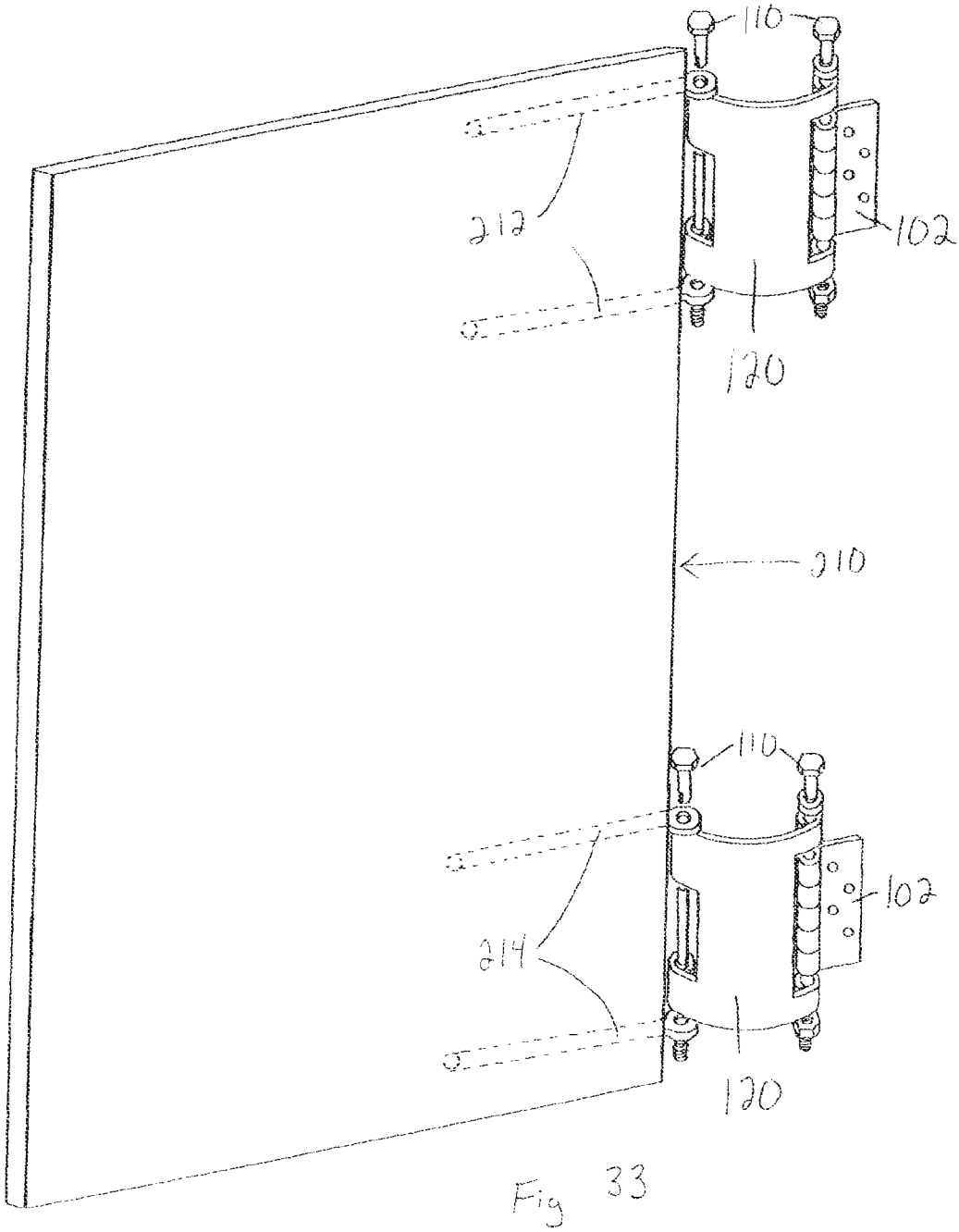
FIG. 33 is a perspective partially exploded view of a double-hinge mortise solid hanger, shown installed with two extenders.

The means for accommodating different sized hinges disclosed herein (i.e. the hanger pin 110/spacers 114 combination and the hanger pin 110/spacers 114/extender 120 combination), also enables attachment of a single hanger to two hinges. The spacing of hinges, whether in two-hinge or three-hinge applications, is fairly consistent throughout North America, but, as doors are often sold as door and door jam combinations, there may be slight variations in the spacing of hinges in the door and door jam combinations produced by different manufacturers. This variation in the spacing between hinges can be accommodated by the use of extenders 120. A double-hinge mortise solid hanger 210, having upper eye rods 212 and lower eye rods 214 is shown installed on two hinges 102 with two extenders 120 in FIG. 33. The hinges 102 are disposed within the larger cavities 124 of the two extenders 120. The span of each larger cavity 124 is greater than the size of the associated hinge 102 thereby permitting some vertical play between each extender 120 and the associated hinge 102, which play is sufficient to accommodate the usual slight variations in the spacing between the hinges 102. If the span of the larger cavity 124 is sufficiently greater than the size of the associated hinge 102, then one or more spacers 114 may also be disposed within the larger cavity 124 to take up any unneeded play (not shown). Alternatively, a double-hinge hanger may be installed without use of extenders 120 so long as the space between each upper pin-receiving hole 106 and lower pin-receiving hole 108 set is sufficient to provide the necessary play for the hinges 102 (not shown).

Figure 34:
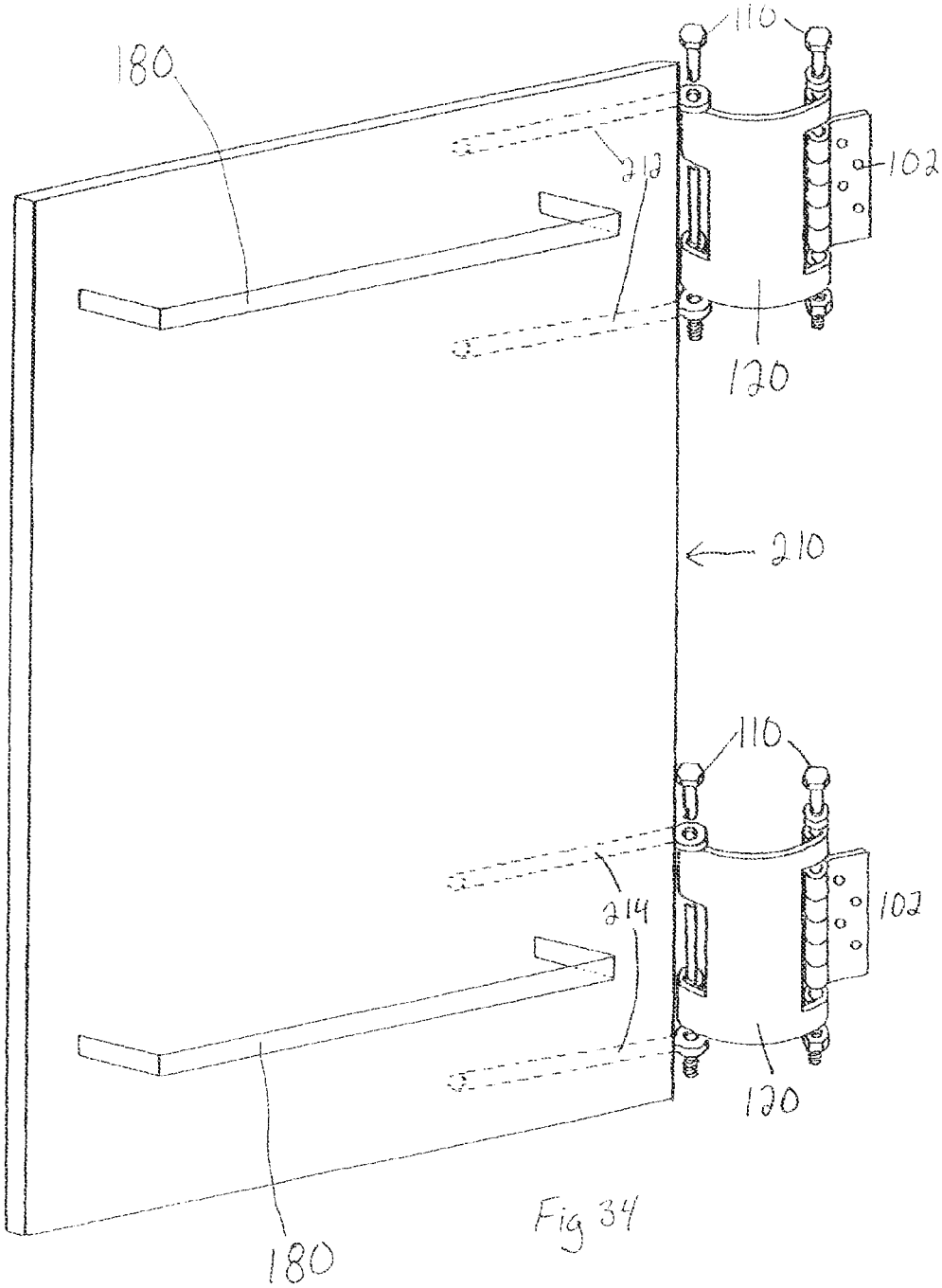
FIG. 34 is a perspective partially exploded view of a double-hinge mortise solid hanger having two side-projecting racks and shown installed with two extenders.
Figure 35:
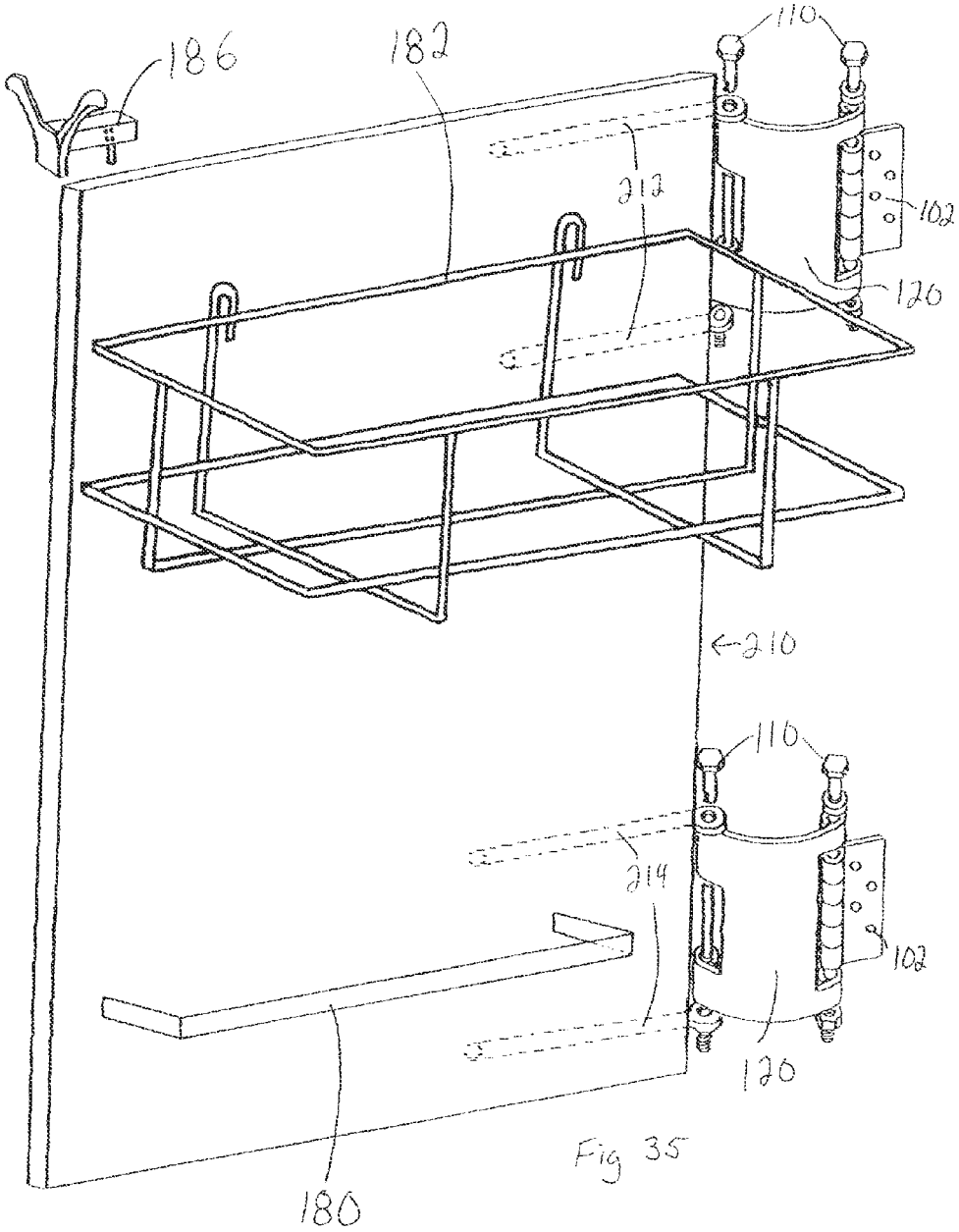
FIG. 35 is a perspective partially exploded view of a double-hinge mortise solid hanger having a wire basket and a side-projecting rack, and shown installed with two extenders.

A double-hinge hanger offers a variety of benefits, particularly where the user wishes to have a substantial work surface or relatively large storage/hanging facility adjacent to a door, but prefers not to mar the door, such as in a rental situation. For example, FIG. 34 shows a double-hinge mortise solid hanger 210 having two side-projecting towel racks 180, one above the other. FIG. 35 shows a double-hinge mortise solid hanger 210 having a side-projecting towel rack 180, wire basket 182 and removable coat hook 186.

As will be apparent to those skilled in the relevant technology in the light of the foregoing description, variants and modifications are possible in the practice of this invention without departing from the spirit or scope thereof. Accordingly, the scope of the invention is to be determined in accordance with the accompanying claims.

What is claimed is:

1. A hanger kit suitable for mounting on a large door hinge having a vertical dimension of a maximum size or on a smaller door hinge having a vertical dimension less than the maximum size by an increment X, the door hinge having a removable hinge pin, and installed to a door and a door jamb, the kit comprising:

a. a hanger pin;

b. a hanger for supporting articles in the vicinity of a door hinge and having two hanger projections spaced apart one from the other by at least the maximum size and each hanger projection having a hanger-pin-receiving hole, the hanger-pin-receiving holes being aligned one with the other;

c. the hanger pin being of sufficient length to extend from one hanger-pin-receiving hole to the other hanger-pin-receiving hole; and d. at least one spacer having an opening through which the hanger pin may pass and having a dimension along an axis defined by the opening of no more than X, wherein, in use with a large door hinge, the hanger may be mounted to the hinge by removing the hinge pin and inserting the hanger pin through one of the hanger-pin-receiving holes, the hinge and the other of the hanger-pin-receiving holes, and in use with a smaller door hinge, the hanger may be mounted to the hinge by removing the hinge pin and inserting the hanger pin through one of the hanger-pin-receiving holes, the hinge, the spacer and the other of the hanger-pin-receiving holes, wherein the hanger comprises a metal frame releasably supporting a plate, wherein the plate may be engaged with the frame in at least two alternative orientations.

2. The hanger kit of claim 1, further comprising:

an extender for installation between the hanger and a hinge, having:

on one side, a larger cavity defined by two large-cavity extender projections spaced apart one from the other by at least the maximum size less X and each large-cavity extender projection having a large-cavity pin-receiving hole, the large-cavity pin-receiving holes being aligned one with the other; and on an opposite side, a smaller cavity defined by two small-cavity extender projections spaced apart one from the other by at least the maximum size less an increment Y, Y being a value greater than X, and each small-cavity extender projection having a small-cavity pin-receiving hole, the small-cavity pin-receiving holes being aligned one with the other; and wherein, each pair of extender projections is configured to fit between the hanger projections; and an extender pin of sufficient length to extend from one hanger-pin-receiving hole to the other hanger-pin-receiving hole;

whereby in use with a smaller door hinge, the extender may be mounted to the hinge by removing the hinge pin and inserting the extender pin through one of the large-cavity pin-receiving holes, the hinge and the other of the large-cavity pin-receiving holes, and the hanger may be mounted to the extender by inserting the hanger pin through one of the hanger-pin-receiving holes, the small-cavity pin-receiving holes and the other of the hanger-pin-receiving holes; and in use with a still-smaller door hinge having a vertical dimension of the maximum size less Y, the extender may be mounted to the hinge by removing the hinge pin and inserting the extender pin through one of the small-cavity pin-receiving holes, the hinge and the other of the small-cavity pin-receiving holes, and the hanger may be mounted to the extender by inserting the hanger pin through one of the hanger-pin-receiving holes, the large-cavity pin-receiving holes and the other of the hanger-pin-receiving holes.

3. The hanger kit of claim 2, wherein Y equals 2X.

4. The hanger kit of claim 2, wherein the extender is curved.

5. The hanger kit of claim 2, wherein the at least one spacer is configured for positioning within the large cavity or the small cavity, wherein the extender may be mounted to a hinge having a vertical dimension less than the maximum size less 2X, by interposing the spacer, with the extender pin passing therethrough, between the hinge and one of the large-cavity extender projections, and the extender may be mounted to a hinge having a vertical dimension less than the maximum size less Y and X, by interposing the spacer, with the extender pin passing therethrough, between the hinge and one of the small-cavity extender projections.

6. The hanger kit of claim 1, further comprising a swing-restraint clip comprising:

a prong for insertion between a door and a door jamb;

a hanger couple connected to the prong and configured for engaging the hanger; and a hanger pin aperture, located between the prong and hanger couple, suitable for receiving the hanger pin;

wherein, in use the clip is secured in place by a hanger pin passing through the hanger pin aperture, the hanger couple is secured to the hanger, and the prong is interposed between the door and door jamb, whereby, the swing of the hanger is restrained by the prong abutting the door or door jam, as the case may be.

7. The hanger kit of claim 1, wherein the hanger has a second pair of hanger projections, and further comprising a second hanger pin, wherein the hanger may be mounted to two hinges.

8. The hanger kit of claim 1, wherein the hanger is an open metal frame.

9. The hanger kit of claim 1, wherein the hanger has a plurality of clothing-supporting devices.

10. The hanger kit of claim 1, wherein the hanger has one or more household-article supporting devices.

* * * * *